US010082136B2

(12) United States Patent
Imai et al.

(10) Patent No.: US 10,082,136 B2
(45) Date of Patent: Sep. 25, 2018

(54) TUBE PUMP

(71) Applicant: Surpass Industry Co., Ltd., Saitama (JP)

(72) Inventors: Hiroshi Imai, Saitama (JP); Kazuki Hirai, Saitama (JP)

(73) Assignee: SURPASS INDUSTRY CO., LTD., Saitama (JP)

( * ) Notice: Subject to any disclaimer, the term of this patent is extended or adjusted under 35 U.S.C. 154(b) by 184 days.

(21) Appl. No.: 15/278,648

(22) Filed: Sep. 28, 2016

(65) Prior Publication Data

US 2017/0096995 A1 Apr. 6, 2017

(30) Foreign Application Priority Data

Oct. 2, 2015 (JP) ..... 2015-196747

(51) Int. Cl.
*F04B 43/12* (2006.01)
*F04B 43/09* (2006.01)
(Continued)

(52) U.S. Cl.
CPC ..... *F04B 43/1253* (2013.01); *F04B 43/09* (2013.01); *F04B 43/12* (2013.01);
(Continued)

(58) Field of Classification Search
CPC .. F04B 43/12; F04B 43/1253; F04B 43/1276; F04B 43/1292; F04B 43/1238; F04B 43/086; A61M 1/039; A61M 5/4232
See application file for complete search history.

(56) References Cited

U.S. PATENT DOCUMENTS 2,696,173 A 12/1954 Jensen
4,441,867 A 4/1984 Berelson
(Continued)

FOREIGN PATENT DOCUMENTS

EP 0 078 092 A1 5/1983
EP 2 113 668 A1 11/2009
(Continued)

OTHER PUBLICATIONS

Partial European Search Report for European Application No. 16190238.2 dated Apr. 5, 2017.
(Continued)

*Primary Examiner* — Peter J Bertheaud
(74) *Attorney, Agent, or Firm* — Muncy, Geissler, Olds & Lowe, P.C.

(57) ABSTRACT

There is provided a tube pump including: a first roller unit and a second roller unit that rotate around an axis while being in contact with a tube; a drive shaft coupled to the first roller unit; a drive cylinder arranged on an outer peripheral side of the drive shaft and coupled to the second roller unit; a first drive unit that rotates a first drive shaft around a first axis; a second drive unit that rotates a second drive shaft around a second axis; and a transmission mechanism that transmits a drive force of the second drive shaft to an outer peripheral surface of the drive cylinder, in which the first drive unit and the second drive unit are arranged so that a first arrangement position of the first drive unit and a second arrangement position of the second drive unit in a first axis direction overlap with each other.

4 Claims, 10 Drawing Sheets

(51) Int. Cl.

| | |
|---|---|
| *F04B 17/03* | (2006.01) |
| *F04B 49/06* | (2006.01) |
| *F04B 49/02* | (2006.01) |
| *F04B 43/08* | (2006.01) |

(52) U.S. Cl.
CPC ..... *F04B 43/1276* (2013.01); *F04B 17/03* (2013.01); *F04B 43/086* (2013.01); *F04B 43/1238* (2013.01); *F04B 49/02* (2013.01); *F04B 49/06* (2013.01)

(56) References Cited

U.S. PATENT DOCUMENTS

| | | | | |
|---|---|---|---|---|
| 5,354,186 | A | 10/1994 | Murtuza et al. | |
| 9,504,784 | B2 * | 11/2016 | Ozturk ..... | A61M 5/14232 |
| 2004/0119794 | A1 | 6/2004 | Youn | |
| 2008/0049064 | A1 | 2/2008 | Asai et al. | |
| 2009/0285706 | A1 | 11/2009 | Bunoz | |
| 2010/0047100 | A1 | 2/2010 | Kojima et al. | |

FOREIGN PATENT DOCUMENTS

| | | | |
|---|---|---|---|
| EP | 2 116 725 | A2 | 11/2009 |
| JP | H5-263765 | A | 10/1993 |
| JP | 2008-308994 | A | 12/2008 |
| JP | 2014-5780 | A | 1/2014 |
| JP | 2014-145279 | A | 8/2014 |

OTHER PUBLICATIONS

Extended European Search Report dated Jul. 7, 2017 (English Language).

* cited by examiner

TUBE PUMP

CROSS-REFERENCE TO RELATED APPLICATIONS

This application is based on Japanese Patent Application No. 2015-196747, the contents of which are incorporated herein by reference in its entirety.

TECHNICAL FIELD

The present disclosure relates to a tube pump.

BACKGROUND ART

Conventionally, there has been known a pump that discharges a fluid from one end side to the other end side of a tube by rotating a pair of pressers to thereby press the tube (for example, refer to Japanese Unexamined Patent Application, Publication No. Hei 5-263765).

In the pump disclosed in Japanese Unexamined Patent Application, Publication No. Hei 5-263765, a rotation shaft to which one presser is coupled is projected upwardly, and a rotation shaft to which the other presser is coupled is projected downwardly. In the pump disclosed in Japanese Unexamined Patent Application, Publication No. Hei 5-263765, drive forces of a pair of electric motors are transmitted to the rotation shafts projecting upwardly and downwardly by a pair of reducers, respectively, and the pair of pressers is rotated at non-constant velocities to thereby discharge the fluid by small pulsation.

SUMMARY

Technical Problem

However, since the pump disclosed in Japanese Unexamined Patent Application, Publication No. Hei 5-263765 has a shape in which the rotation shafts coupled to the pair of pressers are projected upwardly and downwardly, the rotation shafts become long in an axis direction, and the pump becomes large in the axis direction in connection with the shape.

In addition, since the pump has a structure in which each of the pair of rotation shafts projecting upwardly and downwardly is driven by the pair of reducers and the pair of electric motors that are arranged in a width direction perpendicular to the axis direction of the rotation shafts, the pump becomes large in the width direction in connection with the structure.

As described above, the pump disclosed in Japanese Unexamined Patent Application, Publication No. Hei 5-263765 is large in the axis direction of the rotation shafts and the width direction perpendicular to the axis direction, respectively, and reduction in size of the pump is difficult.

The present disclosure has been made in view of such circumstances, and an object thereof is to provide a tube pump in which reduction in size has been achieved while making it possible to independently rotate each of a pair of contact members that rotates in contact with a tube.

Solution to Problem

The present disclosure has employed the following solutions in order to solve the above-described problem.

A tube pump according to a first aspect of the present disclosure includes: a first contact member that rotates around a first axis while being in contact with a tube arranged in a circular-arc shape around the first axis; a second contact member that rotates around the first axis while being in contact with the tube; a shaft member that is arranged on the first axis and is coupled to the first contact member; a cylindrical member that is rotatably arranged around the first axis independently from the shaft member on an outer peripheral side of the shaft member, and is coupled to the second contact member; a first drive unit that has a first drive shaft arranged on the first axis and coupled to the shaft member, and rotates the first drive shaft around the first axis; a second drive unit that has a second drive shaft arranged on a second axis parallel to the first axis, and rotates the second drive shaft around the second axis; and a transmission unit that transmits a drive force of the second drive shaft around the second axis to an outer peripheral surface of the cylindrical member, and rotates the cylindrical member around the first axis. In the above-described tube pump, the first drive unit and the second drive unit are arranged so that a first arrangement position of the first drive unit and a second arrangement position of the second drive unit in a first axis direction along the first axis overlap with each other.

According to the tube pump according to the first aspect of the present disclosure, the first contact member is coupled to the shaft member, and the second contact member is coupled to the cylindrical member rotatably arranged around the first axis independently from the shaft member on the outer peripheral side of the shaft member. Additionally, the first arrangement position of the first drive unit having the first drive shaft that rotates the shaft member around the first axis, and the second arrangement position of the second drive unit having the second drive shaft that rotates the cylindrical member around the first axis through the transmission unit overlap with each other in the first axis direction. Therefore, as compared with a case where the first arrangement position and the second arrangement position are not overlapped with each other in the first axis direction, a size of the tube pump in the first axis direction can be more reduced.

In addition, according to the tube pump according to the first aspect of the present disclosure, since the first drive shaft of the first drive unit arranged on the first axis is coupled to the shaft member coupled to the first contact member, the first drive unit that drives the first drive shaft is arranged on the first axis. Therefore, as compared with a case where the first drive unit is arranged displaced in the width direction to the first axis on which the shaft member is arranged, a size of the tube pump in the width direction can be more reduced.

As described above, according to the tube pump according to the first aspect of the present disclosure, there can be provided the tube pump in which reduction in size has been achieved while making it possible to independently rotate each of the pair of contact members that rotates in contact with the tube.

In the tube pump according to the first aspect of the present disclosure, the transmission unit may have: a first gear that is coupled to the second drive shaft and rotates around the second axis together with the second drive shaft; and a second gear to which the drive force of the second drive shaft is transmitted from the first gear, and that has an inner peripheral surface coupled to the outer peripheral surface of the cylindrical member.

By configuring the tube pump as described above, the drive force of the second drive shaft is transmitted to the outer peripheral surface of the cylindrical member by the transmission unit that can be configured to be comparatively simple and small, the transmission unit having the first gear and the second gear, and the second contact member can be rotated around the first axis.

The tube pump according to the first aspect of the present disclosure may have a configuration in which the tube pump includes: a housing member that houses the first drive unit and the second drive unit thereinside; and a support member that is attached inside the housing member and in which a first through hole extending along the first axis and a second through hole extending along the second axis are formed, in which the first drive unit is attached to the support member in a state where the first drive shaft is inserted into the first through hole, and in which the second drive unit is attached to the support member in a state where the second drive shaft is inserted into the second through hole.

According to the configuration, the first drive unit and the second drive unit are housed inside the housing member, and are attached to the support member. Therefore, the first drive unit and the second drive unit can be set to be a state of being housed in the housing member while being attached to the common support member and being arranged at positions close to each other in the width direction.

A tube pump according to a second aspect of the present disclosure includes: a first contact member that rotates around a first axis while being in contact with a tube arranged in a circular-arc shape around the first axis; a second contact member that rotates around the first axis in the same direction as the first contact member while being in contact with the tube; a first drive unit that has a first drive shaft transmitting a drive force to the first contact member, and rotates the first drive shaft; a second drive unit that has a second drive shaft transmitting a drive force to the second contact member, and rotates the second drive shaft; and a control unit that controls rotation of the first drive shaft by the first drive unit and rotation of the second drive shaft by the second drive unit. In the above-described tube pump, the control unit can execute: a first control mode that rotates the first contact member and the second contact member in the same direction so that discharge of a fluid in the tube by the first contact member and the second contact member is performed; and a second control mode that fixes a rotation angle of each of the first contact member and the second contact member so that the first contact member and the second contact member does not come into contact with the tube.

According to the tube pump according to the second aspect of the present disclosure, the control unit that controls the rotation of the first drive shaft by the first drive unit and the rotation of the second drive shaft by the second drive unit executes the second control mode, and thereby the first contact member and the second contact member can be arranged at retracted positions not in contact with the tube. Replacement of an in-use tube with the other tube can be easily performed by arranging the first contact member and the second contact member at the retracted positions.

Advantageous Effects

According to the present disclosure, there can be provided the tube pump in which reduction in size has been achieved while making it possible to independently rotate each of the pair of contact members that rotates in contact with the tube.

DESCRIPTION OF EMBODIMENTS

Hereinafter, a tube pump 100 of one embodiment of the present disclosure will be explained with reference to drawings.

Figure 1:
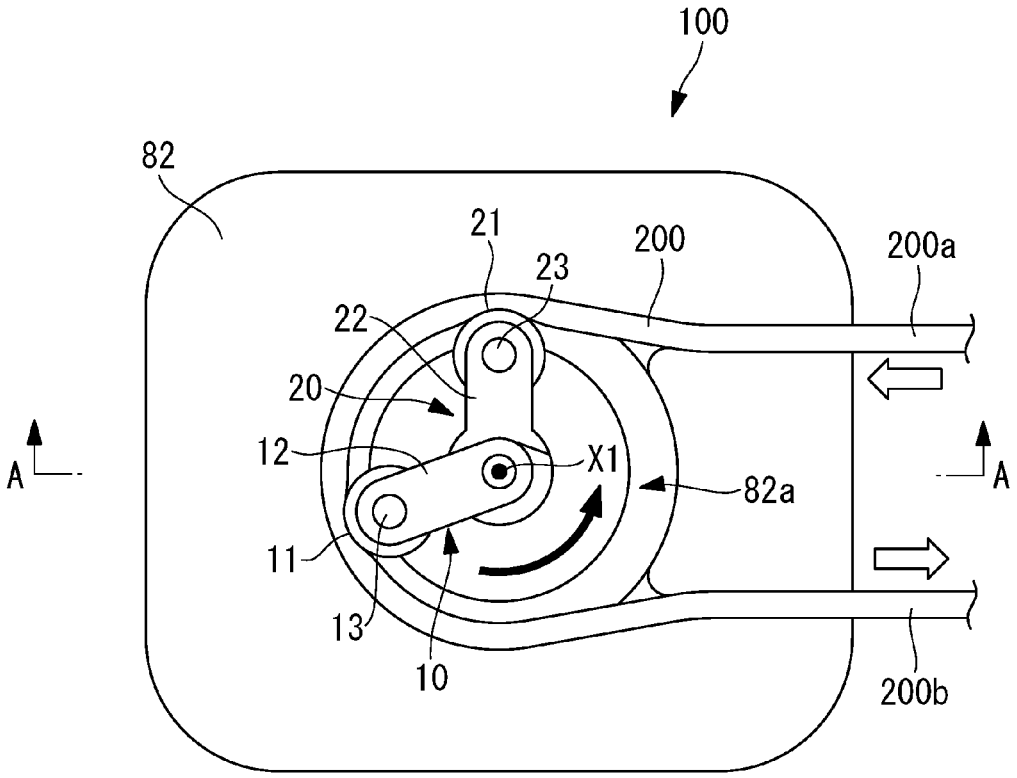
FIG. 1 is a plan view showing one embodiment of a tube pump.

The tube pump 100 of the embodiment shown in FIG. 1 is an apparatus that discharges to an outflow side 200*b* a fluid in a tube 200 flowing in from an inflow side 200*a* by rotating a first roller unit 10 (a first contact member) and a second roller unit 20 (a second contact member) around an axis X1 (a first axis) in the same direction.

As shown in an elevational view of FIG. 1, in the tube pump 100, the tube 200 is arranged in a circular-arc shape around the axis X1 along an inner peripheral surface of a recess 82*a* of a roller housing unit 82 that houses the first roller unit 10 and the second roller unit 20. As shown in FIG. 1, the first roller unit 10 and the second roller unit 20 housed in the roller housing unit 82 rotate around the axis X1 along a counterclockwise rotation direction (a direction shown by an arrow in FIG. 1) while being in contact with the tube 200.

Figure 2:
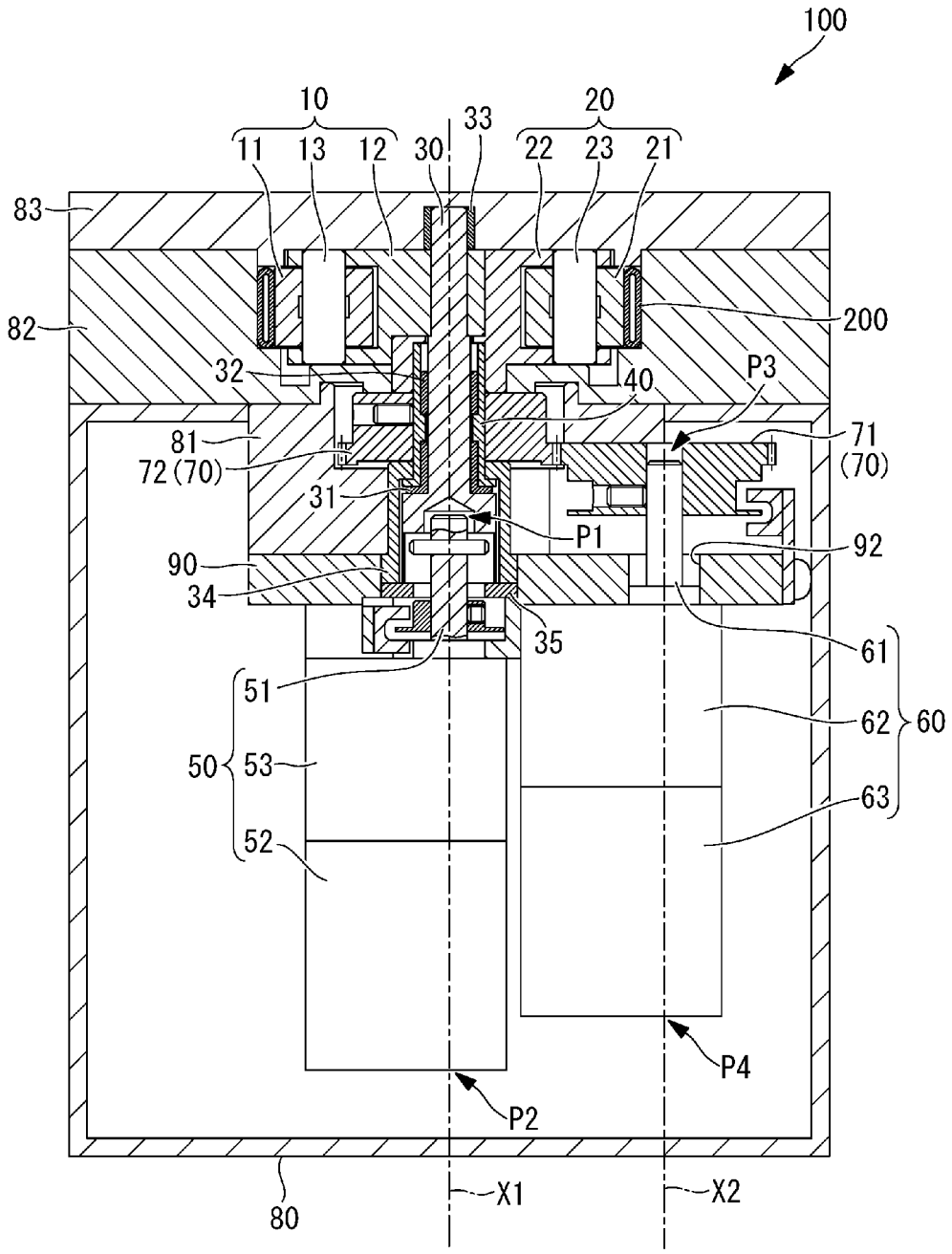
FIG. 2 is a longitudinal cross-sectional view taken along a line A-A of the tube pump shown in FIG. 1.

Note that FIG. 1 shows the tube pump 100 in a state where a cover 83 shown in FIG. 2 is removed.

Figure 3:
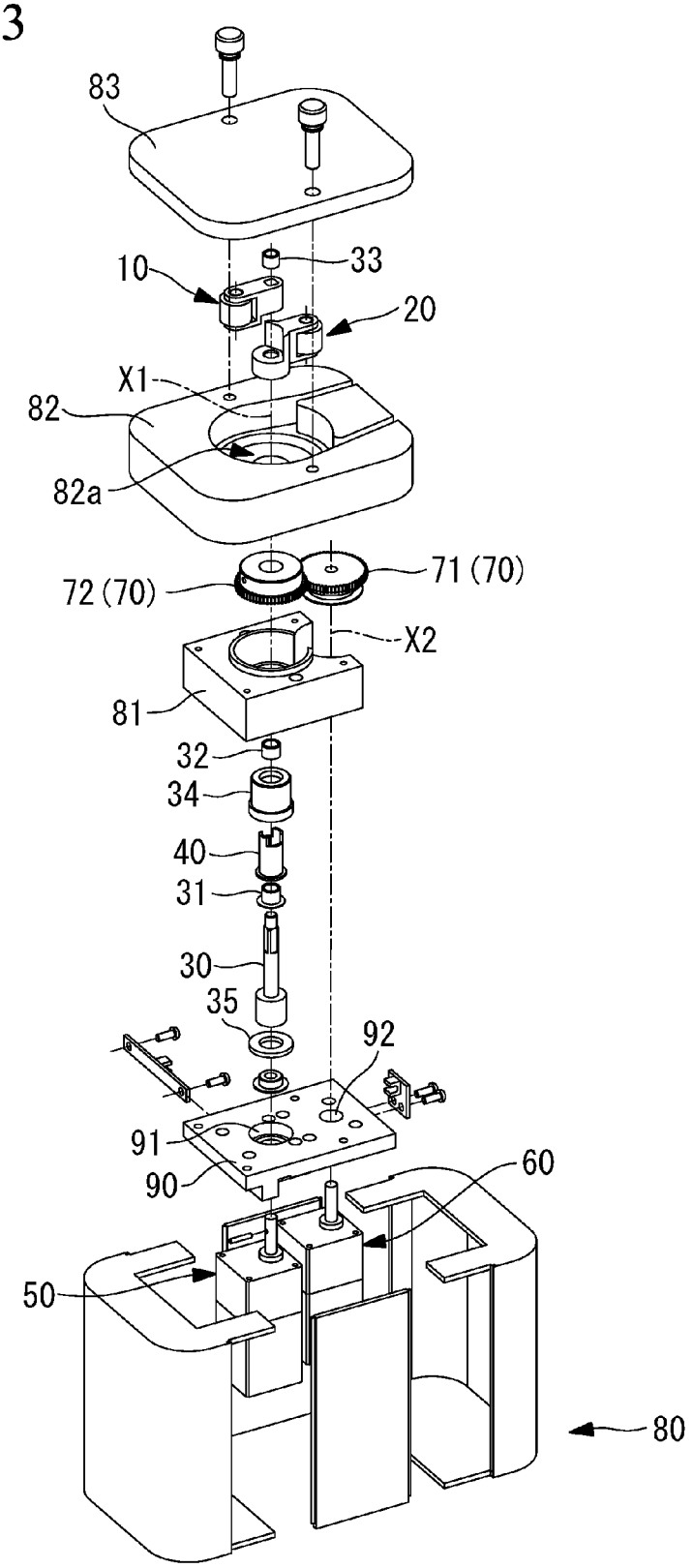
FIG. 3 is an exploded perspective view of the tube pump shown in FIG. 2.

As shown in a longitudinal cross-sectional view of FIG. 2 and an exploded perspective view of FIG. 3, the tube pump 100 of the embodiment includes: the first roller unit 10 and the second roller unit 20 that rotate around the axis X1 while being in contact with the tube 200; a drive shaft 30 (a shaft member) that is arranged on the axis X1 and is coupled to the first roller unit 10; a drive cylinder (a cylindrical member) 40 that is coupled to the second roller unit 20; a first drive unit 50 that transmits a drive force to the drive shaft 30; a second drive unit 60; and a transmission mechanism 70 (a transmission unit) that transmits a drive force of the second drive unit 60 to the drive cylinder 40.

The first roller unit 10 has: a first roller 11 that rotates around an axis parallel to the axis X1 while being in contact with the tube 200; a first roller support member 12 coupled to the drive shaft 30 so as to integrally rotate around the axis X1; and a first roller shaft 13 both ends of which are supported by the first roller support member 12, and to which the first roller 11 is rotatably attached.

The second roller unit 20 has: a second roller 21 that rotates around an axis parallel to the axis X1 while being in contact with the tube 200; a second roller support member 22 coupled to the drive cylinder 40 so as to integrally rotate around the axis X1; and a second roller shaft 23 both ends of which are supported by the second roller support member 22, and to which the second roller 21 is rotatably attached.

As shown in FIG. 2, the first drive unit 50 and the second drive unit 60 are housed inside a casing 80 (a housing member). A gear housing unit 81 for housing the transmission mechanism 70, and a support member 90 that supports the first drive unit 50 and the second drive unit 60 are attached to an inside of the casing 80. In addition, the roller housing unit 82 for housing the first roller unit 10 and the second roller unit 20 is attached to an upper part of the casing 80.

A first through hole 91 that extends along the axis X1 and a second through hole 92 that extends along an axis X2 are formed in the support member 90. The first drive unit 50 is attached to the support member 90 by a fastening bolt (illustration is omitted) in a state where a first drive shaft 51 is inserted into the first through hole 91 formed in the support member 90. Similarly, the second drive unit 60 is attached to the support member 90 by a fastening bolt (illustration is omitted) in a state where a second drive shaft 61 is inserted into the second through hole 92 formed in the support member 90. As described above, each of the first drive unit 50 and the second drive unit 60 is attached to the support member 90, which is the integrally formed member.

As shown in FIG. 2, an arrangement position (a first arrangement position) of the first drive unit 50 in an axis X1 direction is set in a range from a position P1 to a position P2. The position P1 is an upper end position of the first drive shaft 51, and the position P2 is a lower end position of a first electric motor 52, which will be mentioned later.

In addition, an arrangement position (a second arrangement position) of the second drive unit 60 in the axis X1 direction is set in a range from a position P3 to a position P4. The position P3 is an upper end position of the second drive shaft 61, and the position P4 is a lower end position of a second electric motor 62, which will be mentioned later.

As shown in FIG. 2, the first drive unit 50 and the second drive unit 60 are arranged so that the arrangement position (the positions P1 to P2) of the first drive unit 50 in the axis X1 direction and the arrangement position (the positions P3 to P4) of the second drive unit 60 overlap with each other.

Figure 4:
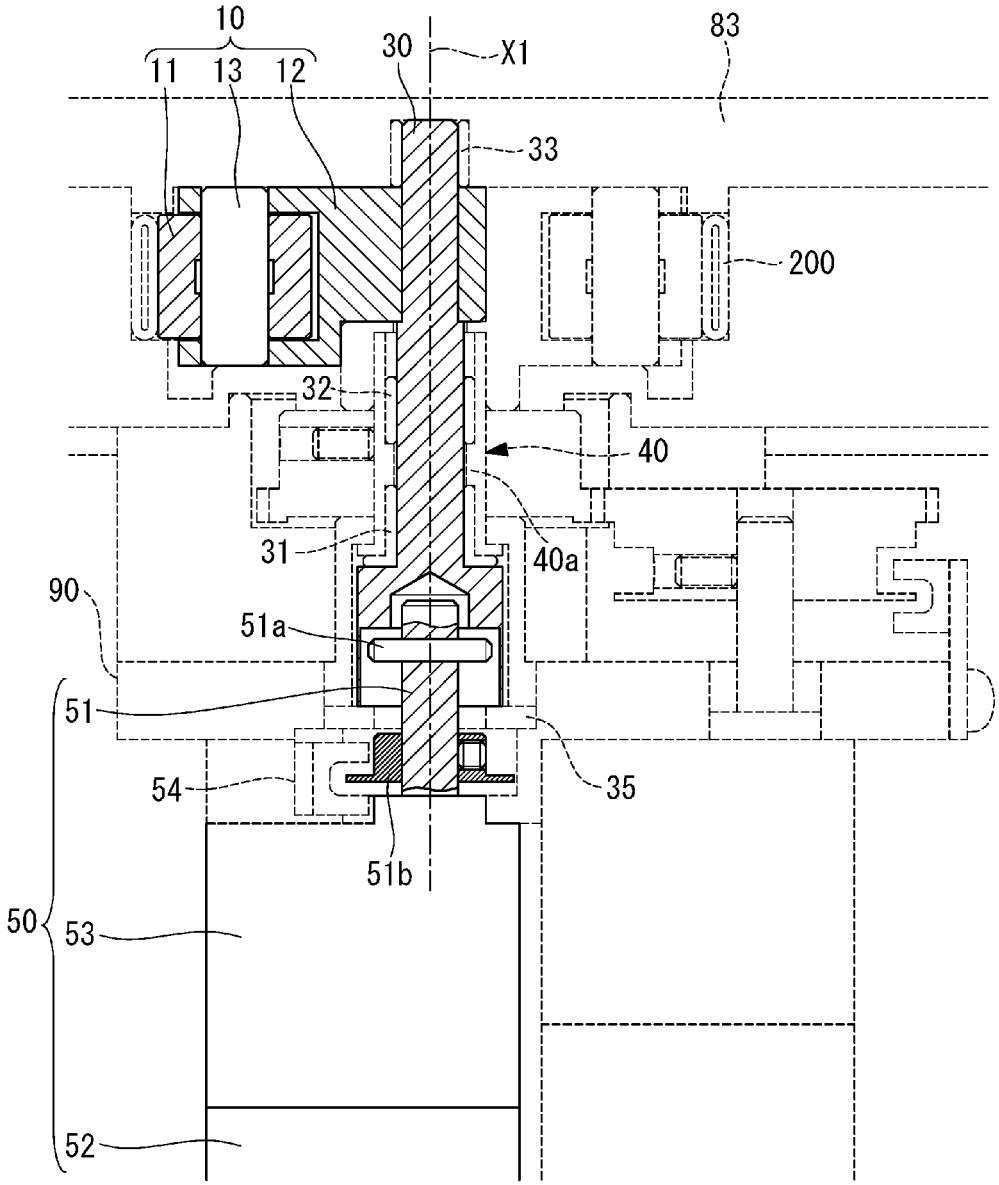
FIG. 4 is a longitudinal cross-sectional view showing a structure in which a first drive unit shown in FIG. 1 transmits a drive force to a first roller unit.

Here, with reference to FIG. 4, there will be explained a structure in which the first drive unit 50 transmits a drive force to the first roller unit 10. In FIG. 4, a portion shown by continuous lines is the portion included in the structure of transmitting a drive force of the first drive unit 50 to the first roller unit 10.

As shown in FIG. 4, the first drive unit 50 has the first drive shaft 51 that is arranged on the axis X1 and is coupled to the drive shaft 30. The first drive shaft 51 is attached to a lower end of the drive shaft 30 in a state where a pin 51*a* that extends in a direction perpendicular to the axis X1 is inserted into the first drive shaft 51. The drive shaft 30 is fixed to the first drive shaft 51 by the pin 51*a* so as not to relatively rotate around the axis X1. Therefore, when the first drive unit 50 rotates the first drive shaft 51 around the axis X1, a drive force of the first drive shaft 51 is transmitted to the drive shaft 30, and the drive shaft 30 rotates around the axis X1.

The first drive unit 50 has; the first drive shaft 51; the first electric motor 52; and a first reducer 53 that reduces a velocity of rotation of a rotation shaft (illustration is omitted) rotated by the first electric motor 52, and transmits the rotation to the first drive shaft 51. The first drive unit 50 rotates the first drive shaft 51 around the axis X1 by transmitting a drive force of the first electric motor 52 to the first drive shaft 51.

A position detecting member 51*b* that rotates around the axis X1 together with the first drive shaft 51 is attached to the first drive shaft 51. In the position detecting member 51*b*, in an annularly formed outer peripheral edge, a slit (illustration is omitted) for detecting a rotation position of the first roller unit 10 around the axis X1 is formed in a peripheral direction around the axis X1.

As shown in FIG. 4, a position detection sensor 54 is arranged so as to sandwich an upper surface and a lower surface of the outer peripheral edge of the position detecting member 51*b*. The position detection sensor 54 is the sensor in which a light-emitting element is arranged on one of an upper surface side and a lower surface side, and in which a light-receiving element is arranged on the other of the upper surface side and the lower surface side. The position detection sensor 54 detects a rotation position indicating which position the first roller unit 10 is arranged around the axis X1 by detecting by the light-receiving element through the slit that light emitted by the light-emitting element passes through in connection with the rotation of the position detecting member 51*b* around the axis X1, and transmits it to a control device 400 (refer to FIG. 6).

The lower end of the drive shaft 30 is coupled to the first drive shaft 51, and an upper end thereof is inserted into an insertion hole formed in the cover 83. A third bearing member 33 that rotatably supports a tip of the first drive shaft 51 around the axis X1 is inserted into the insertion hole of the cover 83.

In addition, the drive shaft 30 is rotatably supported around the axis X1 on an inner peripheral side of the drive cylinder 40 by a cylindrical first bearing member 31 inserted along the outer peripheral surface, and a cylindrical second bearing member 32 formed independently from the first bearing member 31.

As described above, in the drive shaft 30, the outer peripheral surface of a lower end side is supported by the first bearing member 31, the outer peripheral surface of a central portion is supported by the second bearing member 32, and the outer peripheral surface of a tip side is supported by the third bearing member 33. Therefore, the drive shaft 30 smoothly rotates around the axis X1 in a state of holding a central axis on the axis X1.

Note that since the first bearing member 31 and the second bearing member 32 are formed independently from each other, a mechanism that rotatably supports the drive shaft 30 around the axis X1 can be easily assembled by the following procedures.

Firstly, the first bearing member 31 is inserted along the outer peripheral surface of the drive shaft 30. Secondly, the drive cylinder 40 is inserted along the outer peripheral surface of the drive shaft 30. Thirdly, the second bearing member 32 is inserted along the outer peripheral surface of the drive shaft 30. Fourthly, a shaft cover 34 is inserted along an outer peripheral surface of the drive cylinder 40, and thereby the first bearing member 31, the second bearing member 32, and the drive cylinder 40 are prevented from falling off the drive shaft 30.

Here, a reason why the first bearing member 31 and the second bearing member 32 are arranged in the axis X1 direction in a state of being separated from each other as shown in FIG. 4 is that an endless annular projection part 40*a* that extends around the axis X1 is formed at an inner peripheral surface of the drive cylinder 40.

The first roller support member 12 of the first roller unit 10 is coupled to the tip side of the drive shaft 30 so as to integrally rotate around the axis X1.

As described above, the drive force by which the first drive unit 50 rotates the first drive shaft 51 around the axis X1 is transmitted from the first drive shaft 51 to the first roller unit 10 through the drive shaft 30.

As shown in FIG. 4, the lower end of the drive shaft 30 is supported by an upper surface of an annularly formed thrust bearing 35, and a lower surface of the thrust bearing 35 is supported by the support member 90. Therefore, in a case where a downward thrust force is added to the drive shaft 30 along the axis X1, the thrust force is supported by the thrust bearing 35 without being transmitted to the first reducer 53 and the first electric motor 52.

Therefore, in the case where the downward thrust force is added to the drive shaft 30 along the axis X1, it is suppressed by the thrust force that impact is added to the first reducer 53 and the first electric motor 52.

Figure 5:
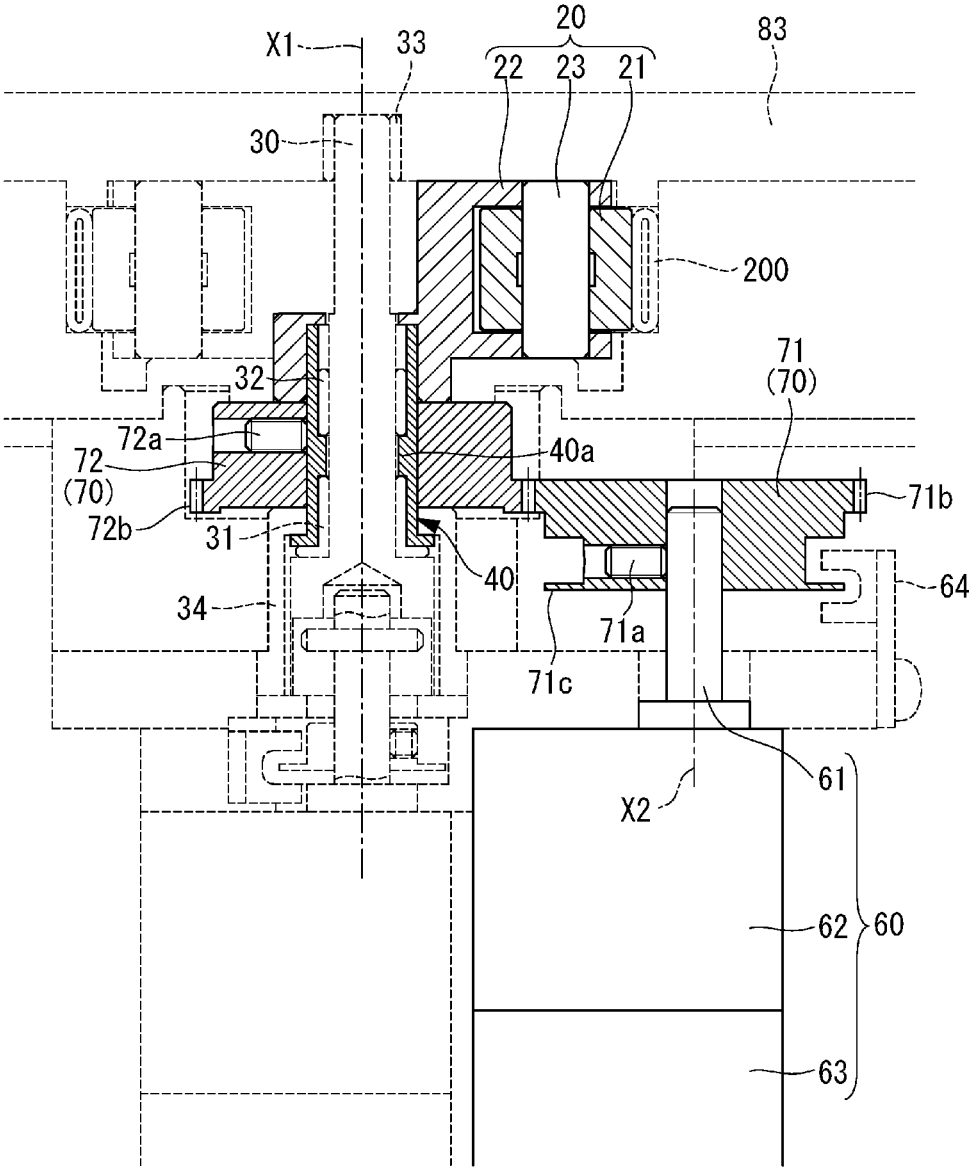
FIG. 5 is a longitudinal cross-sectional view showing a structure in which a second drive unit shown in FIG. 1 transmits a drive force to a second roller unit.

Next, with reference to FIG. 5, there will be explained a structure in which the second drive unit 60 transmits a drive force to the first roller unit 10. In FIG. 5, a portion shown by continuous lines is the portion included in the structure of transmitting the drive force of the second drive unit 60 to the second roller unit 20. The structure shown in FIG. 5 has: the second roller unit 20; the drive cylinder 40; the second drive unit 60; and the transmission mechanism 70.

The transmission mechanism 70 shown in FIG. 5 has: a first gear unit 71 that rotates around the axis X2 (a second axis) parallel to the axis X1; and a second gear unit 72 to which a drive force of the second drive shaft 61 is transmitted from the first gear unit 71. The transmission mechanism 70 transmits the drive force of the second drive shaft 61 around the axis X2 to the outer peripheral surface of the drive cylinder 40, and rotates the drive cylinder 40 around the axis X1.

As shown in FIG. 5, the second drive unit 60 has; the second drive shaft 61 arranged on the axis X2; a second electric motor 62; and a second reducer 63 that reduces a velocity of rotation of a rotation shaft (illustration is omitted) rotated by the second electric motor 62, and transmits the rotation to the second drive shaft 61. The second drive unit 60 rotates the second drive shaft 61 around the axis X2 by transmitting a drive force of the second electric motor 62 to the second drive shaft 61.

The second drive shaft 61 is inserted into an insertion hole formed in a central portion of the first gear unit 71 formed in a cylindrical shape around the axis X2. The first gear unit 71 is fixed to the second drive shaft 61 by fastening a fixing screw 71*a* in a state where the second drive shaft 61 is inserted into the first gear unit 71, and making a tip of the fixing screw 71*a* abut against the second drive shaft 61. In a manner as described above, the first gear unit 71 is coupled to the second drive shaft 61, and rotates around the axis X2 together with the second drive shaft 61.

A first gear 71*b* of the first gear unit 71 formed around the axis X2 is engaged with a second gear 72*b* of the second gear unit 72 formed around the axis X1. Therefore, a drive force by rotation of the first gear unit 71 around the axis X2 is transmitted as the drive force that rotates the second gear unit 72 around the axis X1.

A position detecting member 71*c* that rotates around the axis X1 together with the second drive shaft 61 is formed at the first gear unit 71. In the position detecting member 71*c*, in an annularly formed outer peripheral edge, a slit (illustration is omitted) for detecting a rotation position of the second roller unit 20 around the axis X1 is formed in a peripheral direction around the axis X2.

As shown in FIG. 5, a position detection sensor 64 is arranged so as to sandwich an upper surface and a lower surface of an outer peripheral edge of the position detecting member 71*c*. The position detection sensor 64 is the sensor in which a light-emitting element is arranged on one of an upper surface side and a lower surface side, and in which a light-receiving element is arranged on the other of the upper surface side and the lower surface side. The position detection sensor 64 detects a rotation position indicating which position the second roller unit 20 is arranged around the axis X1 by detecting by the light-receiving element through the slit that light emitted by the light-emitting element passes through in connection with the rotation of the position detecting member 71*c* around the axis X2, and transmits it to the control device 400 (refer to FIG. 6).

The drive cylinder 40 is inserted into an insertion hole formed in a central portion of the second gear unit 72 formed in a cylindrical shape around the axis X1. The insertion hole is a hole having an inner peripheral surface coupled to the outer peripheral surface of the drive cylinder 40.

The second gear unit 72 is fixed to the drive cylinder 40 by fastening a fixing screw 72*a* in a state where the drive cylinder 40 is inserted into the second gear unit 72, and making a tip of the fixing screw 72*a* abut against the drive cylinder 40. In a manner as described above, the second gear unit 72 is coupled to the drive cylinder 40, and rotates around the axis X1 together with the drive cylinder 40.

As shown in FIG. 5, the drive cylinder 40 is arranged in a state of sandwiching the first bearing member 31 and the second bearing member 32 on an outer peripheral side of the drive shaft 30. Therefore, the drive cylinder 40 can be rotated around the axis X1 independently from the drive shaft 30. The drive shaft 30 rotates around the axis X1 by the drive force by the first drive unit 50, and the drive cylinder 40 rotates around the axis X1 by the drive force by the second drive unit 60 in a state of being independent from the drive shaft 30.

The second roller support member 22 of the second roller unit 20 is coupled to a tip side of the drive cylinder 40 so as to integrally rotate around the axis X1.

As described above, the drive force by which the second drive unit 60 rotates the second drive shaft 61 around the axis X2 is transmitted to the outer peripheral surface of the drive cylinder 40 by the transmission mechanism 70, and is transmitted from the drive cylinder 40 to the second roller unit 20.

Next, discharge of a fluid executed by the tube pump 100 of the embodiment will be explained with reference to FIGS. 6 to 13.

Figure 6:
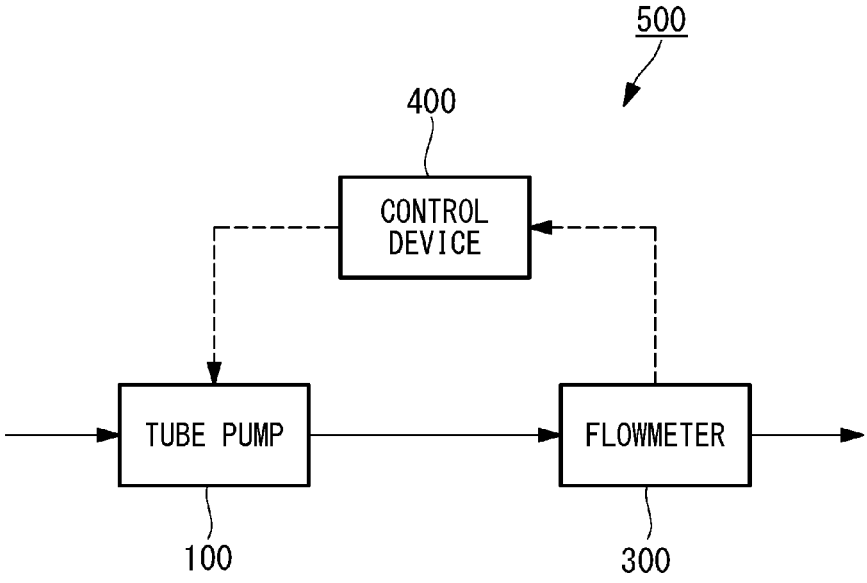
FIG. 6 is a configuration diagram showing one embodiment of a tube pump system.

FIG. 6 is a configuration diagram showing a tube pump system 500 including the tube pump 100 of the embodiment. The tube pump system 500 of the embodiment is the system in which a flow rate of a fluid discharged from the tube pump 100 is measured by a flowmeter 300, and in which the control device 400 receives a result of the measurement, and controls the first drive unit 50 and the second drive unit 60 of the tube pump 100 based on the measurement result.

Note that the tube pump system 500 shown in FIG. 6 transmits a control signal for controlling the first drive unit 50 and the second drive unit 60 of the tube pump 100 from the control device 400 to the tube pump 100.

Note that the tube pump 100 may be configured as an apparatus inside which the control device 400 has been incorporated. In this case, the control device 400 incorporated inside the tube pump 100 generates the control signal for controlling the first drive unit 50 and the second drive unit 60, and transmits it to the first drive unit 50 and the second drive unit 60.

An example shown in FIGS. 7 to 13 is the example in which a fluid in which pulsation has not been generated (a fluid in which fluctuation of the flow rate has not been generated) flows in from the inflow side 200*a* of the tube 200, and is discharged from the outflow side 200*b* in a state where the pulsation is not generated.

The control device 400 shown in FIG. 6 transmits to the tube pump 100 the control signal for controlling the first drive unit 50 and the second drive unit 60 so as to achieve states shown in FIGS. 7 to 13.

FIGS. 7 to 10 are elevational views showing the states where the control device 400 controls the first drive unit 50 and the second drive unit 60 to thereby rotate the first roller unit 10 and the second roller unit 20 around the axis X1.

In the following explanation, rotation angles of the first roller unit 10 and the second roller unit 20 (hereinafter simply referred to as a roller unit in a case where the first roller unit 10 and the second roller unit 20 are collectively referred to) around the axis X1 shall be increased counterclockwise, with a lower end of each drawing being set to be a rotation angle of 0 degree.

Figure 11:
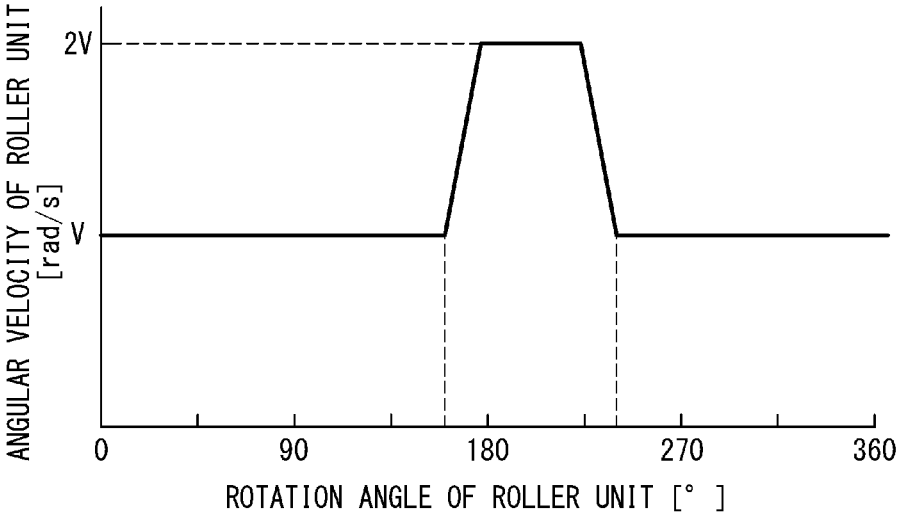
FIG. 11 is a graph showing a relation between a rotation angle and an angular velocity of a roller unit.

FIG. 11 is a graph showing a relation between a rotation angle (degree) and an angular velocity (rad/s) of the roller unit. In a case where an angular velocity of the roller unit from a position of 0 degree to a position of 160 degrees is set to be V, the roller unit rotates around the axis X1 so that the roller unit starts to increase a velocity from a rotation angle of 160 degrees, the angular velocity becomes 2V, subsequently the roller unit starts to decrease the velocity, and so that the angular velocity again becomes V at a rotation angle of 240 degrees. As described above, the first roller unit 10 and the second roller unit 20 rotate with different angular velocities in accordance with the rotation angle around the axis X1. Therefore, a difference in rotation angle between the first roller unit 10 and the second roller unit 20 is increased or decreased when they rotate once around the axis X1.

Figure 12:
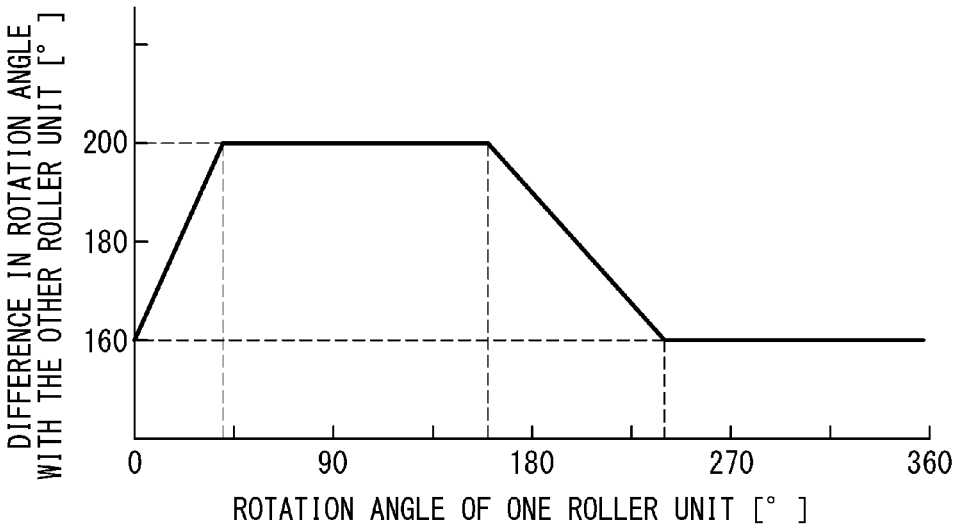
FIG. 12 is a graph showing a relation between a rotation angle of one roller unit and a difference in rotation angle with the other roller unit.

FIG. 12 is a graph showing a relation between a rotation angle of one roller unit and a difference in rotation angle with the other roller unit. A vertical axis shows a current rotation angle of one roller unit in the counterclockwise direction around the axis X1 with respect to a current rotation angle of the other roller unit.

Here, each state shown in FIGS. 7 to 10 will be explained. Note that although specific examples of the rotation angles of the first roller unit 10 and the second roller unit 20 are shown and explained hereinafter, various deformations can be made to specific numerical values of the rotation angles.

Figure 7:
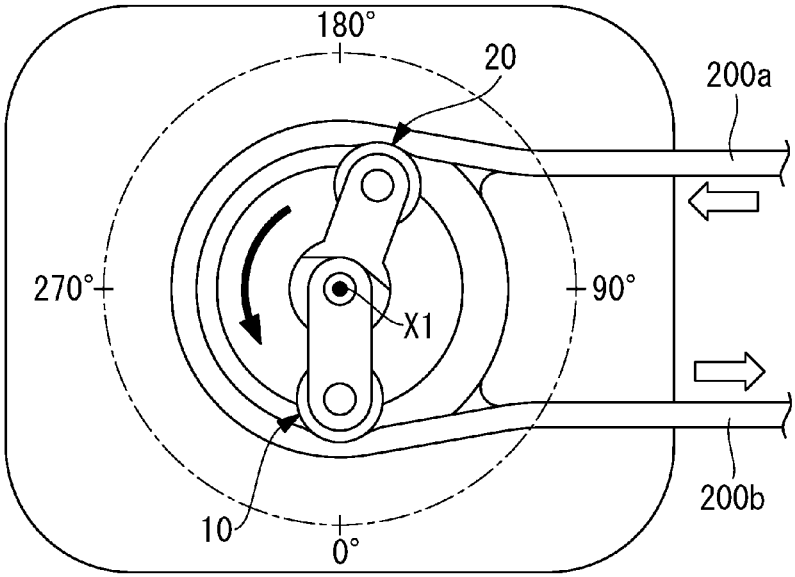
FIG. 7 is a plan view of a tube pump in a state where the first roller unit is arranged at a position of 0 degree.

FIG. 7 shows a state where the first roller unit 10 is arranged at a rotation angle of 0 degree, and where the second roller unit 20 is arranged at a rotation angle of 160 degrees. As shown in FIGS. 7 and 12, in a case where the first roller unit 10 is arranged at the rotation angle of 0 degree, a difference in rotation angle with the second roller unit 20 is 160 degrees.

In the state shown in FIG. 7, each of the first roller unit 10 and the second roller unit 20 is in contact with the tube 200 at the rotation angle of 0 degree and the rotation angle of 160 degrees. Hereby, a fluid inside the tube 200 becomes a state of being substantially blocked in a region from the rotation angle of 160 degrees to a rotation angle of 360 degrees (0 degree).

Figure 8:
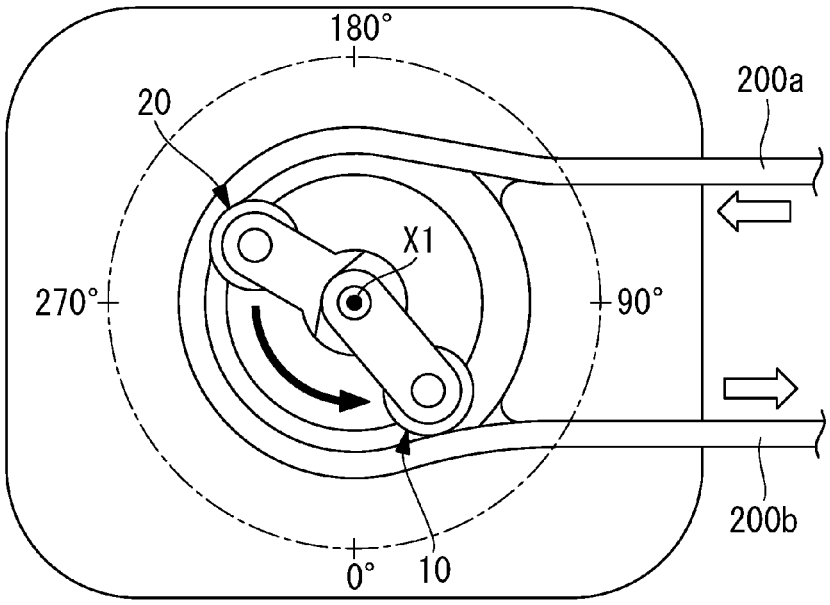
FIG. 8 is a plan view of the tube pump in a state where the first roller unit is arranged at a position of 40 degrees.

FIG. 8 shows a state where the first roller unit 10 is arranged at a rotation angle of 40 degrees, and where the second roller unit 20 is arranged at a rotation angle of 240 degrees. As shown in FIGS. 8 and 12, in a case where the first roller unit 10 is arranged at the rotation angle of 40 degrees, a difference in rotation angle with the second roller unit 20 is 200 degrees.

A reason why the difference in rotation angle between the first roller unit 10 and the second roller unit 20 becomes larger to 200 degrees in the state shown in FIG. 8 although it is 160 degrees in the state shown in FIG. 7 is that the angular velocity (2V) of the second roller unit 20 is larger than the angular velocity (V) of the first roller unit 10.

In the state shown in FIG. 8, each of the first roller unit 10 and the second roller unit 20 is in contact with the tube 200 at the rotation angle of 40 degrees and the rotation angle of 240 degrees. Hereby, the fluid inside the tube 200 becomes the state of being blocked so as not to flow backward to the inflow side 200*a* by the second roller unit 20. In a process in which the state shown in FIG. 7 changes to the state shown in FIG. 8, the fluid blocked inside the tube 200 changes from a state of being blocked in a range of a rotation angle of 200 degrees (a range from the position of 160 degrees to a position of 360 degrees) to a state of being blocked in a range of a rotation angle of 120 degrees (a range from a position of 240 degrees to the position of 360 degrees).

The first roller unit 10 is gradually separated from the tube 200 by further rotating from the state shown in FIG. 7.

In the embodiment, a pressure of the fluid blocked inside the tube 200 rises in the process in which the state shown in FIG. 7 changes to the state shown in FIG. 8. Therefore, even if the first roller unit 10 is separated from the tube 200, drawing of the fluid from a downstream side to an upstream side of the tube 200 is suppressed by the pressure of the fluid blocked inside the tube 200. Hereby, it is suppressed that pulsation is generated in the fluid discharged from the tube pump 100.

Figure 9:
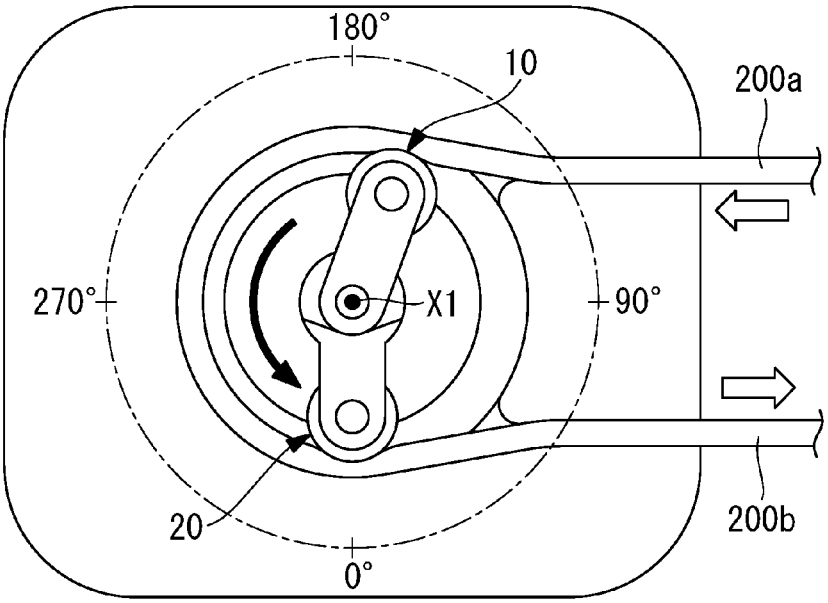
FIG. 9 is a plan view of the tube pump in a state where the first roller unit is arranged at a position of 160 degrees.

In the state shown in FIG. 9, the first roller unit 10 again comes into contact with the tube 200, and is arranged at the rotation angle of 160 degrees. In addition, the second roller unit 20 is arranged at the rotation angle of 360 degrees (0 degree). A reason why the rotation angles of the first roller unit 10 and the second roller unit 20 are the same as the state shown in FIG. 8 is that the angular velocity (V) of the first roller unit 10 and the angular velocity (V) of the second roller unit 20 are the same as each other (refer to FIG. 12).

Figure 10:
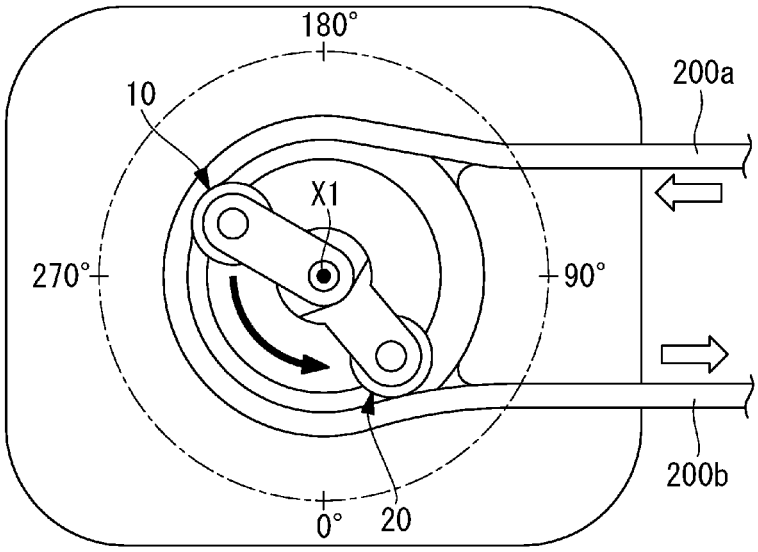
FIG. 10 is a plan view of the tube pump in a state where the first roller unit is arranged at a position of 240 degrees.

In the state shown in FIG. 10, the first roller unit 10 is arranged at the rotation angle of 240 degrees, and the second roller unit 20 is arranged at the rotation angle of 40 degrees. A reason why the difference in rotation angle between the first roller unit 10 and the second roller unit 20 increases from 160 to 200 degrees as compared with the state shown in FIG. 9 is that the angular velocity (2V) of the first roller unit 10 is larger than the angular velocity (V) of the second roller unit 20 (refer to FIG. 12).

The tube pump 100 again becomes the state shown in FIG. 7 after the state shown in FIG. 10. The tube pump 100 repeats operations in which the state shown in FIG. 7 sequentially changes to the states shown in FIGS. 8, 9, and 10, and in which the state shown in FIG. 10 again returns to the state shown in FIG. 7, whereby the tube pump 100 continuously makes the fluid flow from the inflow side 200*a* to the outflow side 200*b*.

Figure 13:
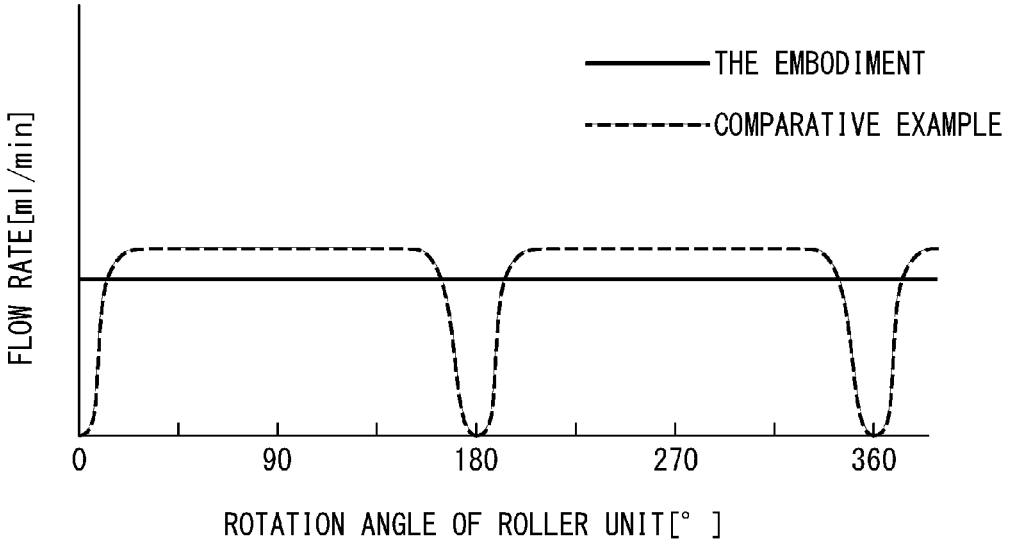
FIG. 13 is a graph showing a relation between a rotation angle of the roller unit and a flow rate.

FIG. 13 is a graph showing a relation between a rotation angle of the roller unit and a flow rate of a fluid discharged to the outflow side 200*b* of the tube 200 in the tube pump 100 of the embodiment.

A Comparative Example shown by a broken line in FIG. 13 is the example in which the first roller unit 10 and the second roller unit 20 are rotated at a constant rotation velocity, while a difference in rotation angle therebetween is maintained to be 180 degrees. As shown in FIG. 13, in the Comparative Example, change in flow rate is large in the rotation angles of 0 and 180 degrees at which the roller unit starts to move in a direction separated from the tube 200. This is because when the roller unit starts to move in the direction separated from the tube 200, deformation of the tube 200 is eliminated, and thereby a negative pressure that draws the fluid from the downstream side to the upstream side is generated.

Meanwhile, in the embodiment shown by a continuous line in FIG. 13, there is no change in flow rate, and a constant flow rate is maintained, in the rotation angles of 0 and 180 degrees at which the roller unit (the first roller unit 10 or the second roller unit 20) starts to move in the direction separated from the tube 200. This is because when the roller unit starts to move in the direction separated from the tube 200, a pressure of the fluid blocked inside the tube 200 rises.

In addition, the tube pump 100 of the embodiment maintains a constant flow rate also in rotation angles other than the rotation angles of 0 and 180 degrees at which the roller unit (the first roller unit 10 or the second roller unit 20) starts to move in the direction separated from the tube 200. This is because as shown in FIG. 11, the roller unit rotates at the constant rotation velocity (V) in a range of the rotation angles until the subsequent roller unit starts to move in the direction separated from the tube 200 after the preceding roller unit starts to move in the direction separated from the tube 200.

Next, there will be explained a tube replacement mode in which the in-use tube 200 is removed from the tube pump 100 to be replaced with the other tube.

The tube pump 100 of the embodiment can execute a discharge control mode (a first control mode) that rotates the first roller unit 10 and the second roller unit 20 in the same direction so that discharge of the fluid in the tube 200 by the first roller unit 10 and the second roller unit 20 is performed, by the control signal from the control device 400, as shown in FIGS. 7 to 10.

In the discharge control mode, since either one of the first roller unit 10 and the second roller unit 20 is in contact with the tube 200 as shown in FIGS. 7 to 10, it is not easy to replace the tube 200.

The tube pump 100 of the embodiment can execute the tube replacement mode (a second control mode) instead of the discharge control mode, by the control signal from the control device 400.

Figure 14:
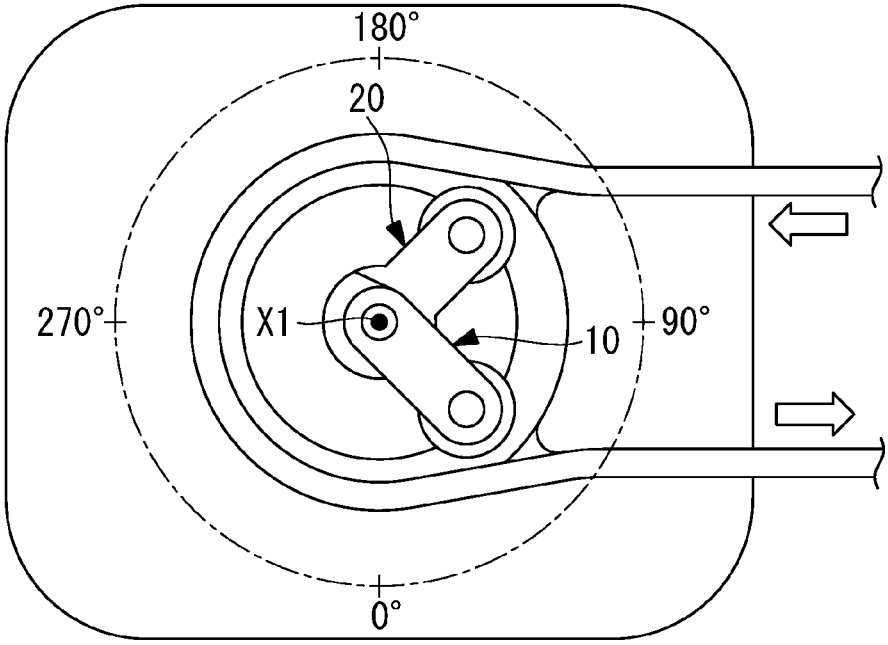
FIG. 14 is a plan view of the tube pump showing a state where the first roller unit and the second roller unit are retracted in retracted positions.

In a case of making the tube pump 100 operate in the tube replacement mode, the control device 400 fixes the rotation angle of each of the first roller unit 10 and the second roller unit 20 so that the first roller unit 10 and the second roller unit 20 do not come into contact with the tube 200. The rotation angles at which the first roller unit 10 and the second roller unit 20 do not come into contact with the tube 200 are the ones shown in FIG. 14.

In the above explanation, although the tube pump 100 is set to be able to execute the discharge control mode and the tube replacement mode by the control signal from the control device 400, other aspects may be employed. For example, the control device 400 may be incorporated into the tube pump 100, and the tube pump 100 may include a control unit that controls rotation of the first drive shaft 51 by the first drive unit 50 and rotation of the second drive shaft 61 by the second drive unit 60.

There will be explained actions and effects exerted by the tube pump 100 of the embodiment explained above.

According to the tube pump 100 of the embodiment, the first roller unit 10 is coupled to the drive shaft 30, the second roller unit 20 is coupled to the drive cylinder 40 rotatably arranged around the axis X1 independently from the drive shaft 30 on the outer peripheral side of the drive shaft 30. Additionally, the first arrangement position of the first drive unit 50 having the first drive shaft 51 that rotates the drive shaft 30 around the axis X1, and the second arrangement position of the second drive unit 60 having the second drive shaft 61 that rotates the drive cylinder 40 around the axis X1 through the transmission mechanism 70 overlap with each other in the axis X1 direction. Therefore, as compared with a case where the first arrangement position and the second arrangement position are not overlapped with each other in the axis X1 direction, a size of the tube pump 100 in the axis X1 direction can be more reduced.

In addition, according to the tube pump 100 of the embodiment, since the first drive shaft 51 of the first drive unit 50 arranged on the axis X1 is coupled to the drive shaft 30 coupled to the first roller unit 10, the first drive unit 50 that drives the first drive shaft 51 is arranged on the axis X1. Therefore, as compared with a case where the first drive unit 50 is arranged displaced in a width direction to the axis X1 on which the drive shaft 30 is arranged, a size of the tube pump 100 in the width direction can be more reduced.

As described above, according to the tube pump 100 of the embodiment, there can be provided the tube pump 100 in which reduction in size has been achieved while making it possible to independently rotate each of the pair of roller units that rotates in contact with the tube 200.

In the tube pump 100 of the embodiment, the transmission mechanism 70 has: the first gear unit 71 that is coupled to the second drive shaft 61 and rotates around the axis X2 together with the second drive shaft 61; and the second gear unit 72 to which the drive force of the second drive shaft 61 is transmitted from the first gear unit 71, and that has an inner peripheral surface coupled to the outer peripheral surface of the drive cylinder 40.

By configuring the tube pump 100 as described above, the drive force of the second drive shaft 61 is transmitted to the outer peripheral surface of the drive cylinder 40 by the transmission mechanism 70 that can be configured to be comparatively simple and small, the transmission mechanism 70 having the first gear unit 71 and the second gear unit 72, and the second roller unit 20 can be rotated around the axis X1.

The tube pump 100 of the embodiment includes: the casing 80 that houses the first drive unit 50 and the second drive unit 60 thereinside; and the support member 90 that is attached inside the casing 80, and in which the first through hole 91 extending along the axis X1 and the second through hole 92 extending along the axis X2 are formed. The first drive unit 50 is attached to the support member 90 in a state where the first drive shaft 51 is inserted into the first through hole 91, and the second drive unit 60 is attached to the support member 90 in a state where the second drive shaft 61 is inserted into the second through hole 92.

By configuring the tube pump 100 as described above, the first drive unit 50 and the second drive unit 60 are housed inside the casing 80, and are attached to the support member 90. Therefore, the first drive unit 50 and the second drive unit 60 can be set to be a state of being housed in the casing 80 while being attached to the common support member 90 and being arranged at positions close to each other in the width direction.

In addition, according to the tube pump 100 of the embodiment, the control unit that controls the rotation of the first drive shaft 51 by the first drive unit 50 and the rotation of the second drive shaft 61 by the second drive unit 60 executes the tube replacement mode, and thereby the first roller unit 10 and the second roller unit 20 can be arranged at retracted positions not in contact with the tube 200. Replacement of the in-use tube with the other tube can be easily performed by arranging the first roller unit 10 and the second roller unit 20 at the retracted positions.

OTHER EMBODIMENTS

Although the example shown in FIGS. 7 to 13 is the example in which the fluid in which pulsation has not been generated (the fluid in which fluctuation of the flow rate has not been generated) flows in from the inflow side 200*a* of the tube 200, and is discharged from the outflow side 200*b* in the state where the pulsation is not generated, other examples may be employed.

For example, the control device 400 may be configured such that the fluid in which pulsation has not been generated (the fluid in which fluctuation of the flow rate has not been generated) flows in from the inflow side 200*a* of the tube 200, and is discharged from the outflow side 200*b* in a state where predetermined pulsation is generated.

In this case, the control device 400 transmits to the tube pump 100 a control signal that controls the first drive unit 50 and the second drive unit 60 so that change (pulsation) in flow rate of the fluid measured by the flowmeter 300 is the predetermined pulsation (a state where a cycle of the change in flow rate, and a change amount of the flow rate are predetermined ones).

In addition, for example, the control device 400 may be configured such that the fluid in which the predetermined pulsation has been generated flows in from the inflow side 200*a* of the tube 200, and is discharged from the outflow side 200*b* in a state where the same pulsation is generated. Namely, the fluid may be made to flow out from the outflow side 200*b* in a state where the pulsation of the fluid flowing in from the inflow side 200*a* is maintained.

In this case, the control device 400 transmits to the tube pump 100 a control signal that controls the first drive unit 50 and the second drive unit 60 so that change (pulsation) in flow rate of the fluid measured by the flowmeter 300 is the predetermined pulsation (a state where a cycle of the change in flow rate, and a change amount of the flow rate are predetermined ones).

While in the above description, the transmission mechanism 70 directly transmits the driving force from the first gear unit 71 to the second gear unit 72, the present disclosure may be configured otherwise.

For example, the transmission mechanism 70 may indirectly transmits the driving force from the first gear unit 71 to the second gear unit 72 through a rubber driving belt connected to the first gear unit 71 and the second gear unit 72.

The invention claimed is:

1. A tube pump comprising:

a first contact member that rotates around a first axis while being in contact with a tube arranged in a circular-arc shape around the first axis;

a second contact member that rotates around the first axis while being in contact with the tube;

a shaft member that is arranged on the first axis and is coupled to the first contact member;

a cylindrical member that is rotatably arranged around the first axis independently from the shaft member on an outer peripheral side of the shaft member, and is coupled to the second contact member;

a first drive unit that has a first drive shaft arranged on the first axis and coupled to the shaft member, and rotates the first drive shaft around the first axis;

a second drive unit that has a second drive shaft arranged on a second axis parallel to the first axis, and rotates the second drive shaft around the second axis; and a transmission unit that transmits a drive force of the second drive shaft around the second axis to an outer peripheral surface of the cylindrical member, and rotates the cylindrical member around the first axis, wherein the first drive unit and the second drive unit are arranged so that a first arrangement position of the first drive unit and a second arrangement position of the second drive unit in a first axis direction along the first axis overlap with each other.

2. The tube pump according to claim 1, wherein the transmission unit has: a first gear that is coupled to the second drive shaft and rotates around the second axis together with the second drive shaft; and a second gear to which the drive force of the second drive shaft is transmitted from the first gear, and that has an inner peripheral surface coupled to the outer peripheral surface of the cylindrical member.

3. The tube pump according to claim 1, further comprising:

a housing member that houses the first drive unit and the second drive unit thereinside; and a support member that is attached inside the housing member, and in which a first through hole extending along the first axis and a second through hole extending along the second axis are formed, wherein the first drive unit is attached to the support member in a state where the first drive shaft is inserted into the first through hole, and the second drive unit is attached to the support member in a state where the second drive shaft is inserted into the second through hole.

4. A tube pump comprising:

a first contact member that rotates around a first axis while being in contact with a tube arranged in a circular-arc shape around the first axis;

a second contact member that rotates around the first axis in the same direction as the first contact member while being in contact with the tube;

a first drive unit that has a first drive shaft transmitting a drive force to the first contact member, and rotates the first drive shaft;

a second drive unit that has a second drive shaft transmitting a drive force to the second contact member, and rotates the second drive shaft; and a control unit that controls rotation of the first drive shaft by the first drive unit and rotation of the second drive shaft by the second drive unit, wherein the control unit can execute: a first control mode that rotates the first contact member and the second contact member in the same direction so that discharge of a fluid in the tube by the first contact member and the second contact member is performed; and a second control mode that fixes a rotation angle of each of the first contact member and the second contact member so that the first contact member and the second contact member do not come into contact with the tube.

* * * * *